United States Patent [19]

Schrittwieser

[11] 4,217,141

[45] Aug. 12, 1980

[54] PROCESS FOR PRODUCING HARD, WEAR-RESISTANT BORON-CONTAINING METAL BODIES

[75] Inventor: Karl Schrittwieser, Edenvale, South Africa

[73] Assignee: Sintermetallwerk Krebsöge GmbH, Krebsöge, Fed. Rep. of Germany

[21] Appl. No.: 884,639

[22] Filed: Mar. 8, 1978

[30] Foreign Application Priority Data

Mar. 9, 1977 [ZA] South Africa ..... 77/1419

[51] Int. Cl.[2] ..... C22C 1/04; C22C 1/05

[52] U.S. Cl. ..... 75/244; 75/201; 75/202; 75/205; 75/214; 75/224

[58] Field of Search ..... 75/244, 201, 202, 205, 75/214, 224

[56] References Cited

U.S. PATENT DOCUMENTS

| | | | |
|---|---|---|---|
| 3,977,838 | 8/1976 | Hashimoto et al. | 75/244 X |
| 4,123,266 | 10/1978 | Foley et al. | 75/244 |

*Primary Examiner*—Richard E. Schafer

*Attorney, Agent, or Firm*—Karl F. Ross

[57] ABSTRACT

A boron-containing powder in an amount of up to 25% by weight is mixed with a metal powder (e.g. steel) and the mixture is compacted in a mold to at least 80% of theoretical density. The compact is sintered at 700° to 1300° C. under a protective atmosphere or vacuum to yield a hard, wear-resistant body.

11 Claims, No Drawings

PROCESS FOR PRODUCING HARD, WEAR-RESISTANT BORON-CONTAINING METAL BODIES

FIELD OF THE INVENTION

The present invention relates to the production of hard bodies from metal powders and, more particularly, to the manufacture of metal bodies of high hardness and which have high wear resistance, combined with high strength or good corrosion resistance or high heat resistance or any combination of these characteristics.

BACKGROUND OF THE INVENTION

The hardest metal bodies produced on a commercial scale for machining processes, drilling operations and other applications where wear resistance is necessary are cemented metal carbides. The most common of these is tungsten carbide which is sometimes combined with other carbides such as those of Ti, Cr, Ta and others. These materials are expensive to manufacture and are, where possible, frequently replaced in industry by high-speed steels and Stellites. Since the hard carbides are usually present in a softer matrix, their macro hardness is limited to about 68 on the Rockwell 'C' scale.

Metallic borides are a group of materials which are very hard and comparable in this respect with carbides, nitrides and oxides and it is known to use boriding powders or pastes to obtain bodies with a very high surface hardness. Boriding powders are powders containing boron and particularly boron carbide which, when sintered with appropriate metals, forms the borides. The surface-hardening process is effected by a diffusion mechanism. This process involves diffusing boron into the surface of a metal body by bringing the boriding compound into close contact with the surface to be hardened and then allowing diffusion to take place whereby various metallic boride phases are formed. The boron usually diffuses to a depth of 500 microns although greater depths are attainable. The layer thus produced can have a hardness on the order of $HR_c$ 90 depending on the matrix and its treatment.

OBJECTS OF THE INVENTION

It is an object of the invention to provide an improved method of making hard, wear-resistant bodies.

Another object is to provide improved hard wear-resistant bodies of metal.

Still another object of the invention is to provide a radiation shield with improved radiation-absorption capabilities.

It is also an object of the invention to provide an improved pipeline shield for the transportation of abrasive materials or a beater for use in a mill.

SUMMARY OF THE INVENTION

The process of the present invention provides for the manufacture of hard, wear-resistant metal bodies by mixing normal metal powders obtained in conventional powder-metallurgy production with boron or a boron-producing material (generally: boron-contained powder) and if necessary an activator for the boron, compacting the mixture to a high density in a mold, and sintering the compacted material under vacuum or a protective atmosphere (non-oxidizing conditions). According to the invention the boron-containing powder is boron and/or boron carbide and/or titanium boride and is present in an amount of up to 25% by weight of the metal powder, the mixture being compacted prior to sintering to a density of at least 80% of the theoretical value.

A feature of the invention resides in admixing with the mixture a powdered boronizing activator (e.g. a halide, especially $KBF_4$) in an amount of up to 30% by weight of boronizing agent. In the mixture the particles should have a size not greater than 400 microns nor less than 50 microns.

According to another feature of the invention, a die lubricant is combined with the mixture in the amount of between 0.5% and 1.5% by weight.

The compaction step can be effected by axially subjecting the mixture hot or cold to compaction under a pressure of between 400 and 1200 $MN/m^2$.

Alternatively, the mixture is isostatically subjected hot or cold to compaction under a pressure of between 400 and 1200 $MN/m^2$.

Advantageously, the metal powder consists by weight of more than 70% iron, 2 to 20% nickel, 2 to 20% Cr and 1 to 10% molybdenum and 0 to 4% Cu, Va and/or W. Alternatively, the metal powder consists of at least 30% nickel and up to 70% of mixtures of two or more of Cu, Co, Mo, W and Cr.

To the mixture may be added abrasive particles such as diamond and/or cubic boron nitride before and/or after the metal powder is borided.

It has been found that hardness of the body can be controlled by regulating the amount of boriding powder added, the temperature of sintering and the length of time the sintering temperature is maintained. Bodies having tailored hardnesses may thus be produced.

The hard bodies can be used for a variety of purposes. A metal-bonded abrasive-containing body, for example, comprising diamond or cubic-boron-nitride abrasive particles held in a metal bonding matrix, can have a metal bonding matrix consisting of cobalt, and abrasive particles present in an amount of at least 50% by weight of and substantially uniformly distributed throughout the matrix. The body can be used as an abrasive wheel for grinding purposes. The metal-bonding matrix can consist substantially only of cobalt and boron in the form of cobalt borides, the boron being present in an amount of 0.5 to 3% by weight of the matrix. The abrasive-particle content of the body can be 5 to 15% by volume of the body.

A nonabrasive body according to the invention can advantageously be fabricated as a radiation shield with high capacity for radiation absorption, as a wear-resistant shield in pipelines for the transportation of abrasive materials, or as a beater for use in mills.

SPECIFIC DESCRIPTION AND EXAMPLES

The production of a hard, wear-resistant body will depend, insofar as the choice of material is concerned, on the use to which the body is to be put. The base material must be chosen to give the required properties in the finally alloyed body. Materials which will find wide application are iron, chromium, nickel and cobalt, but other metals such as platinum and osmium can be used to accommodate particularly severe working conditions. The powders used must afford a good compressibility so that a high green density can be achieved with cold pressing and powders having a particle size of 400 microns have proved satisfactory.

The boronizing material can conveniently be any boron-containing substance, unstable at the diffusion temperature in the presence of a catalyst (i.e. certain halides), thus causing the diffusion of the element boron into the surface of the material to be treated.

Also it is preferable particularly where isostatic pressure is not used to compact the powder in the mold, to use a die lubricant such as wax, stearates or stearic acid in quantities of up to 2% of the weight of the powders introduced into the mold.

To effect the process, the boron-producing powder is used in an amount up to 25% of the weight of metal powder and the weight of activator is between 2% and 30% of that of the boron-producing material. The hardening is dependent on the degree of boronizing which is achieved and in this way the hardness can be selectively produced to meet the requirements for the particular article made.

The powder and selected proportions of boron-producing agent and activator are thoroughly mixed and then introduced into the mold. The mixture is subjected to a pressure up to $10\times10^6$ MPa to obtain the desired degree of compaction. This can be done in a normal mold by axial pressure or, where large articles such as tubes or plates and the like are to be made, isostatic compaction of the material can be used. In this manner a green density of more than 80% of the theoretical density can be achieved. This high density imparts a green strength to the compacted part sufficient to enable it to be machined to a limited extent without difficulty because the matrix is in a soft state after the diffusion cycle.

The compacted article is then sintered. The sintering bonds the particles with one another and effects the homogenization of the alloy. The sintering temperature can range from 900° to 1300° C. and is related to the composition of the alloy. The sintering is carried out for up to 6 hours under a protective atmosphere. Assisted by the activator, the boronizing material, e.g. the $B_4C$, reacts with the metal particles by diffusion so that homogenization takes place.

In, for example, the iron/boron system, the boron-to-iron concentration passes during sintering the stoichiometric concentration of the eutectic point so that there occurs temporarily a liquid phase which accelerates the diffusion process significantly and produces further densification.

Where bodies having even higher performances are necessary, hot pressing as has been used in powder metallurgy heretofore can be employed. It is carried out either with the normal axial pressing process with temperatures of 800° to 1000° C., or by the hot isostatic pressing process.

The hardness of the achieved materials can be more than 80 Rockwell C, with microhardness of 2000 Vickers (HVO,1 ) and more for a large quantity of particles in the structure. The tensile strength can be 200 to 800 MPa depending on the composition of the alloy.

Iron alloy materials can be made using, for example, powders of iron with 2 to 20% nickel and/or 1 to 6% manganese and/or 2 to 18% chromium alternatively with smaller additions of copper, cobalt, titanium molybdenum, tungsten and/or vanadium.

Also metal powders such as cobalt or nickel, for example, can have even harder abrasive particles of material such as diamond or cubic boron nitride embedded therein. This enables cutting tools for very hard materials to be obtained.

It is to be understood, however, that metals other than those specifically mentioned may be similarly treated and in particular rare metals such as platinum, uranium and osmium can be used, thus enabling the inherent physical characteristics of these metals to be exploited in applications not previously possible.

Particular mention must be made of composite articles which can be obtained from the sintering of borided platinum and diamond. Bearings of this mixture can be used submerged in hot and highly corrosive acids with a long life. The noble-metal platinum has heretofore been considered as too soft to provide the necessary mechanical strength for such articles.

EXAMPLE 1

A highly compressible iron powder, e.g. ASC 100.29, was mixed with 10% nickel, 2% copper, 8% boron carbide ($B_4C$) and 1% $KBF_4$ and 1.2% acrawax (all in weight percent), in a double-cone mixer for half an hour, compacted under a low pressure into a test bar (80% of the theoretical density) and sintered at 1080° C. for 2.5 hours under vacuum.

The bar had:

1. a density of 94% of the theoretical value;
2. a hardness of 74 Rockwell 'C';
3. a transverse rupture strength of 250 N/mm$^2$; and
4. excellent wear resistance proved under a sandblasting test when compared to components hardened by conventional surface treatments, e.g. nitriding, carburizing etc.

EXAMPLE 2

A highly compressible iron powder was mixed with 5% Mo, 7% Cr, 2.5 VC, 7% $B_4C$ and 1% $KBF_4$. The mixture was isostatically subjected to a pressure of 6000 MPa to form a tube of 200 mm, inner diameter and 400 mm long, with 20 mm. wall thickness (80% of theoretical density). The sintering was done at 1120° C. under vacuum with small additions of nitrogen for 3 hours, resulting in 1. a density of 98% of the theoretical value;
2. a hardness of 76 to 78 Rockwell 'C';
3. a tensile strength of 300 N/mm$^2$; and
4. excellent wear resistance proved under a sandblasting test as above.

EXAMPLE 3

The mixture of Example 1 was subjected to a pressure of 400 MPa heated to 950° C. and forged into a bar having a density of 98% of the theoretical value. The part then was homogenized for one hour under vacuum at 1050° C. The bar had:

1. a hardness of 86 Rockwell 'C';
2. a tensile strength of 650 MPa, and
3. excellent wear resistance proved under a sandblasting test.

EXAMPLE 4

The following powdered mixture was made (all percentages by weight):

80 percent diamond particles
4 percent $B_4C$
1 percent $KBF_4$.

The mixture was placed in a mold defining a saw segment and cold compacted to a density of about 90% of the theoretical density. The compacted mixture in the mold was sintered at 800° C. for a period of 30 minutes. Recovered from the mold was a saw segment consisting of diamond particles embedded in a cobalt matrix having a Rockwell 'C' hardness of 75.

EXAMPLE 5

A segment was made for a coring bit in the following manner. Powdered cobalt was mixed with about 4% by weight of a commercially available boriding powder named Degussa "G 27 ". The mixture was heated to a temperature of about 900° C. and this temperature was maintained for about 60 minutes. The boriding powder was then mixed with diamond particles. The diamond particles constituted about 10% by volume of the mixture. The diamond-containing mixture was placed in a mold and sintered at a temperature of 950° C. A segment was recovered from the mold which was found to have a Rockwell C hardness of 60 to 95. This was very much harder and tougher than a similar segment made in the conventional manner without the boriding step where the Rockwell B hardness was found to be about 90 to 100 (which is about 8 to 10 on the Rockwell C scale). Furthermore, the use of a borided cobalt enabled the sintering to take place at a low temperature of 950° C. To achieve the same bond hardness without the use of a borided cobalt, it is necessary to use other metals which can be sintered only above 1030° C. at which temperatures synthetic diamond tends to graphitize.

In all of the above, sintering was effected under vacuum. Similar results were obtained in each case when sintering was carried out under a protective atmosphere of argon.

I claim:

1. A method of producing a hard, wear-resistant body which comprises the steps of:

mixing a metal powder with 0.5 to 25% by weight of the metal powder of a boronizing agent selected from the group which consists of a boron, boron carbide and titanium boride;

compacting the mixture to a density of at least 80% of the theoretical density of said mixture;

sintering the resulting compact at a temperature of 700° to 1300° C. under nonoxidizing conditions to form said body and effect diffusion of boron from said boronizing agent into the metal powder and substantially homogeneous distribution of the boron in said body; and adding to the mixture a boronizing activator in an amount of up to 30% by weight of said boronizing agent.

2. The method defined in claim 1 wherein said activator is $KBF_4$.

3. A method of producing a hard, wear-resistant body which comprises the steps of:

mixing a metal powder with 0.5 to 25% by weight of the metal powder of a boronizing agent selected from the group which consists of boron, boron carbide and titanium boride;

compacting the mixture to a density of at least 80% of the theoretical density of said mixture;

sintering the resulting compact at a temperature of 700° to 1300° C. under nonoxidizing conditions to form said body and effect diffusion of boron from said boronizing agent into the metal powder and substantially homogeneous distribution of the boron in said body, the particles of said mixture having a particle size range between 50 to 400 microns, inclusive.

4. The method defined in claim 3, further comprising combining with said mixture a lubricant in an amount of 0.5 to 1.5% by weight.

5. The method defined in claim 3 wherein the mixture is compacted at a pressure between 400 and 1200 $MN/m^2$.

6. The method defined in claim 5 wherein said metal powder consists essentially of:

at least 70% by weight iron, 2 to 20% by weight nickel, 2 to 20% by weight chromium, 1 to 10% by weight molybdenum, and 0 to 4% by weight each of copper, vanadium or tungsten.

7. The method defined in claim 5 wherein said metal powder consists essentially of at least 30% by weight nickel and up to 70% by weight of at least two elements selected from the group which consists of copper, cobalt, molybdenum, tungsten and chromium.

8. A method of producing a hard, wear-resistant body which comprises the steps of:

mixing a metal powder with 0.5 to 25% by weight of the metal powder of a boronizing agent selected from the group which consists of boron, boron carbide and titanium boride;

compacting the mixture to a density of at least 80% of the theoretical density of said mixture;

sintering the resulting compact at a temperature of 700° to 1300° C. under nonoxidizing conditions to form said body and effect diffusion of boron from said boronizing agent into the metal powder and substantially homogeneous distribution of the boron in said body; and incorporating into said body abrasive particles selected from the group which consists of diamond and cubic boron nitride.

9. A metal-bonded abrasive body made by the method of claim 8 wherein the abrasive particles are held in a metal matrix consisting predominantly of cobalt.

10. The body defined in claim 9 wherein said matrix consists essentially of cobalt and boron in the form of cobalt borides in which the boron is present in an amount of 0.5 to 3% by weight of the matrix, the abrasive particles being present in an amount of 5 to 15% by weight of the body.

11. A hard, wear-resistant body made by the method of claim 6.

* * * * *